US009587432B1

(12) United States Patent
Valdez

(10) Patent No.: US 9,587,432 B1
(45) Date of Patent: Mar. 7, 2017

(54) GATE OPENER

(71) Applicant: Jose M Valdez, Miami, FL (US)

(72) Inventor: Jose M Valdez, Miami, FL (US)

( * ) Notice: Subject to any disclaimer, the term of this patent is extended or adjusted under 35 U.S.C. 154(b) by 0 days.

(21) Appl. No.: 15/214,089

(22) Filed: Jul. 19, 2016

(51) Int. Cl.
*E05F 11/00* (2006.01)
*E06B 11/02* (2006.01)
*E05F 15/00* (2015.01)

(52) U.S. Cl.
CPC ..... *E06B 11/026* (2013.01); *E05F 15/00* (2013.01); *E05Y 2201/654* (2013.01); *E05Y 2201/668* (2013.01); *E05Y 2900/40* (2013.01)

(58) Field of Classification Search
CPC ..... E05F 15/00; E05F 15/643; E05F 17/004; E05F 2017/005; E06B 11/021
See application file for complete search history.

(56) References Cited

U.S. PATENT DOCUMENTS

| | | | | | |
|---|---|---|---|---|---|
| 320,786 | A * | 6/1885 | Holbrook | B66B 13/303 | 16/194 |
| 492,502 | A | 2/1893 | McAnamey | | |
| 503,361 | A * | 8/1893 | De Vry | E05F 15/643 | 49/123 |
| 542,069 | A * | 7/1895 | Tackaberry | E05F 15/643 | 49/123 |
| 599,083 | A * | 2/1898 | Westin | E05F 15/643 | 49/123 |
| 718,626 | A | 1/1903 | Hodgens | | |
| 783,582 | A * | 2/1905 | Hodgens | E05F 15/643 | 49/123 |
| 1,126,380 | A * | 1/1915 | Brown | E05F 15/643 | 49/123 |
| 1,307,126 | A | 6/1919 | Hodgson | | |
| 1,463,647 | A | 7/1923 | Coss | | |
| 1,469,165 | A | 9/1923 | Marsh | | |
| 1,596,350 | A | 8/1926 | Guicheteau | | |
| 1,602,717 | A | 10/1926 | Keith | | |
| 1,795,452 | A | 3/1931 | Smelser | | |
| 1,810,320 | A | 6/1931 | Michaelson | | |
| 2,235,381 | A | 3/1941 | McCormick | | |
| 4,781,270 | A * | 11/1988 | Holland | B66B 13/08 | 187/313 |
| 5,178,199 | A | 1/1993 | Jackson | | |
| 5,193,307 | A | 3/1993 | Chupp | | |
| 5,813,717 | A | 9/1998 | Wilson | | |
| 6,779,306 | B2 | 8/2004 | Hormann | | |
| 6,968,645 | B2 * | 11/2005 | Epps | E05B 65/0835 | 49/116 |
| 7,730,929 | B2 | 6/2010 | Perron | | |

* cited by examiner

*Primary Examiner* — Katherine Mitchell
*Assistant Examiner* — Abe Massad
(74) *Attorney, Agent, or Firm* — Christopher J. VanDam, PA; Chris Vandam

(57) ABSTRACT

A gate opener for simultaneously operating a pair of opposed sliding gates. The gate opener includes a pair of identical pulley assemblies one each affixed to the ground adjacent to a either gate and oriented a hundred eighty degrees to each other. A first cable is affixed to a lateral edge of a first gate, passes through a series of pulleys and is affixed to a medial edge of a second gate. A second cable is affixed to a lateral edge of a second gate, passes through a series of pulleys and is affixed to a medial edge of the first gate.

2 Claims, 4 Drawing Sheets

GATE OPENER

BACKGROUND OF THE INVENTION

1. Field of the Invention

The present invention relates to sliding traffic gates, and more particularly, to a device and method to open and close gates.

2. Description of the Related Art

Several designs for gate openers have been designed in the past. None of them, however, includes modular devices that are used in pairs to aid in opening and closing a pair of sliding gates when force is applied in either direction on either of the gates.

Applicant believes that the closest reference corresponds to U.S. Pat. No. 1,602,717 issued to Smith. However, it differs from the present invention because the Smith device, as with other similar devices, requires reversal of a connected motor that is connected to either pull doors together or apart. The present invention by contrast can be powered open or closed from any point along either of the gates without motorized power being applied to the cables.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a gate opener that can be used with one motor to close or open both gates simultaneously.

It is another object of this invention to provide a device that allows great flexibility of the location of a motor because it is not connected to the cable movements.

It is still another object of the present invention to provide a gate closer using two copies of a single pulley assembly, one rotated a hundred and eighty degrees from the other.

It is yet another object of this invention to provide such a device and method of use that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
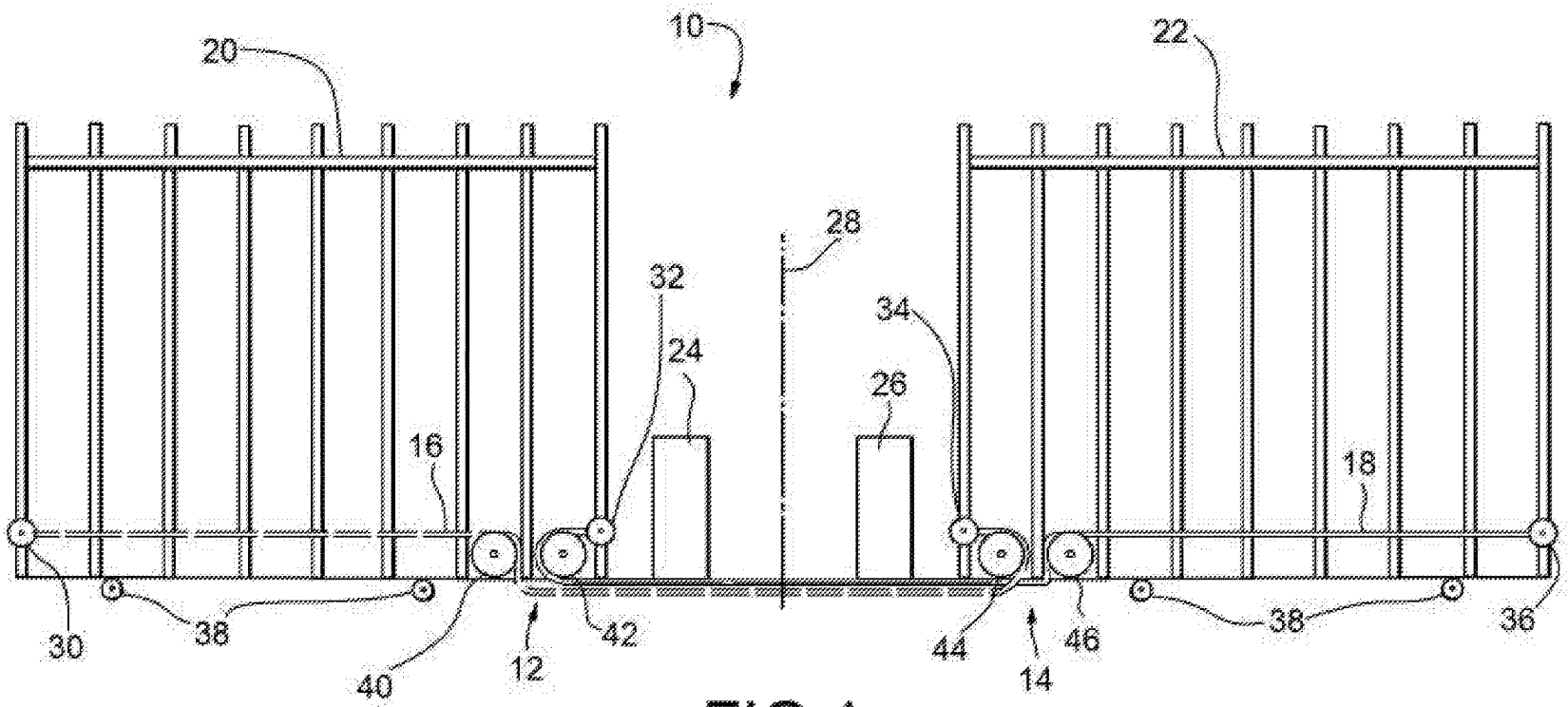
FIG. 1 shows an elevation view of an open gate.

Sliding gates are used on many driveways and other lanes of pedestrian and vehicle traffic. When designing a gate to span an opening such as a driveway it is frequently necessary to employ two opposed gates rather than one longer gate. Since the space required for two smaller opposed gates is generally more flexible, they can be adapted for use in many environments.

A problem arises when automating the open and close function on these gates. Each gate must be independently motorized. This requires multiple motors as well as supporting infrastructure including switches, safety controls, electrical supply and other components. Of course, more components means more initial costs, more maintenance, higher likelihood of failure, duplicated maintenance costs, additional physical equipment space and more labor.

The present invention solves these problems by mechanically linking the gates together so that when one gate is forced towards the centerline then the other is also forced to the centerline. Similarly, when either gate is forced into an open position then the complementary gate is also equally opened.

This has an important benefit in that a motor may be now placed anywhere convenient along either section of gate. The opening or closing force is then effected on both gates equally. For example, in space limited applications it may only be possible to have one motor. In another example, supplying power may only be feasible to one or the other side of the driveway so the motor placement may be influenced by the location of available power.

Another benefit of the present invention is that two identical copies of pulley assemblies can be used. The pulley assembly on the right side gate is the same as that used with the left side gate, only rotated one hundred eighty degrees. On other words, the pulley assembly is not inherently designed for the right or left side. Instead, the mere orientation of the device adapts it for use on the left or right. This has obvious advantages to manufacturing, repair parts, ease of installation and overall simplicity of the system.

The subject device and method of use is sometimes referred to as the device, the invention, opener, gate opener, gates, machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Referring now to the drawings, where the present invention is generally referred to with numeral 10, it can be observed that it basically includes a pulley assembly 12, a pulley assembly 14, a cable 16, a cable 18, a gate 20, a gate 22, a post 24, a post 26, a centerline 28, an anchor 30, an anchor 32, an anchor 34, an anchor 36, wheels 38, a pulley 40, a pulley 42, a pulley 44, a pulley 46, a pulley 48, an axle 50, an axle 52, a case assembly 54, an aperture 56, an aperture 58, an aperture 60, an aperture 62, a sub-box 64, a sub-box 66, a pulley 68, a sub-box 70, a sub box 72, an aperture 74, an aperture 76, an aperture 78, an aperture 80, an axle 82, an axle 84, a channel assembly 86, a rail 88, a covering 90, a conduit 92, a fastener 94, a channel assembly 96, a rail 97, a covering 98 and a conduit 99.

Figure 2:
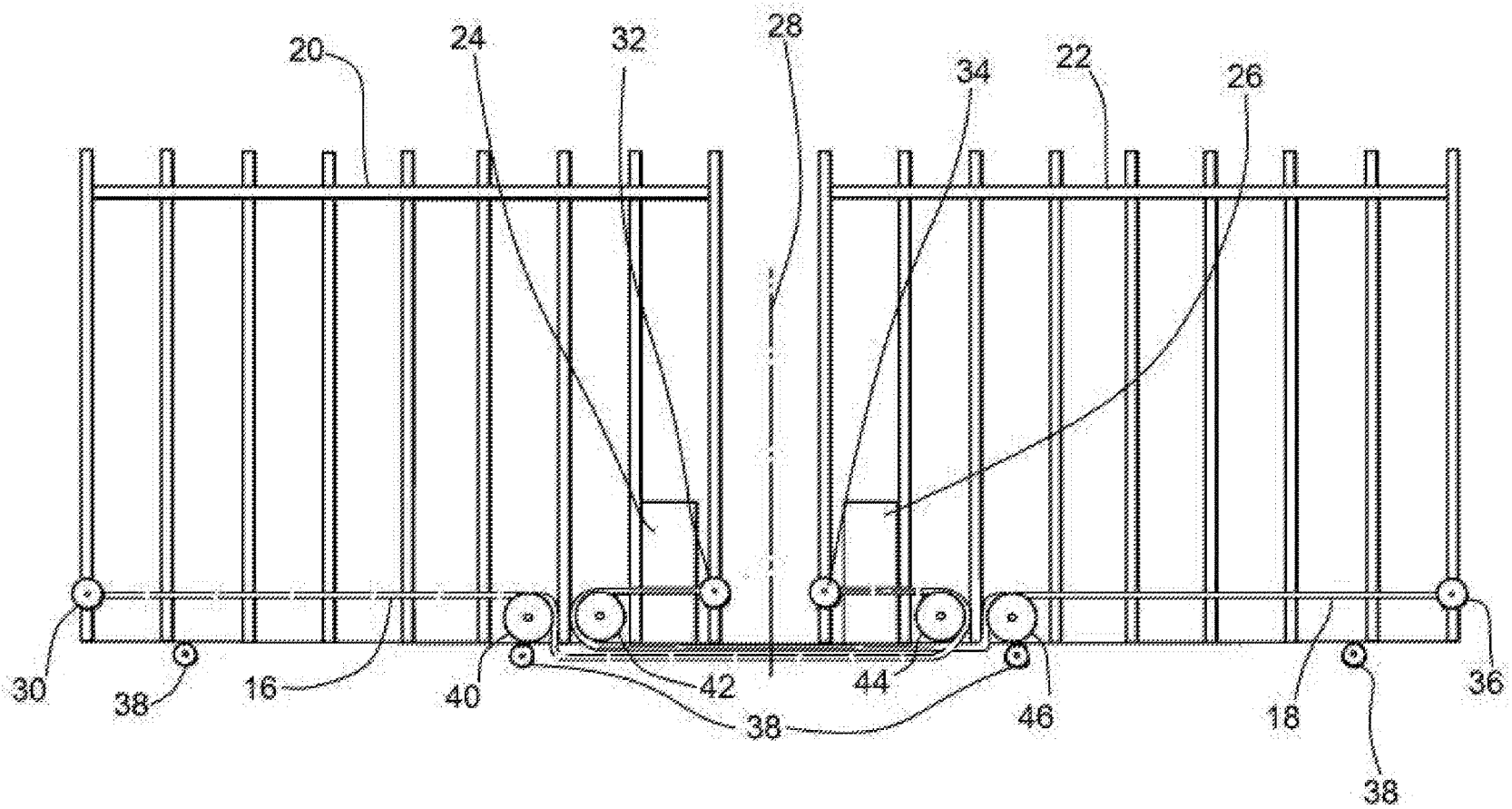
FIG. 2 shows an elevation view of a nearly closed gate.

FIG. 1 shows the gate 20 and gate 22 in an open position. FIG. 2 shows the same gates 20 and 22 in a nearly closed position. The centerline 28 is the imaginary point where gates 20 and 22 meet together when fully closed.

The post 24 and post 26 are not required for the operation of the gate opener. Posts 24 and 26 are provided for context and generally define the traffic lane between open gates. Posts 24 and 26 are utilized in many installations to protect the gates 20 and 22 from impact and resulting damage.

Figure 3:
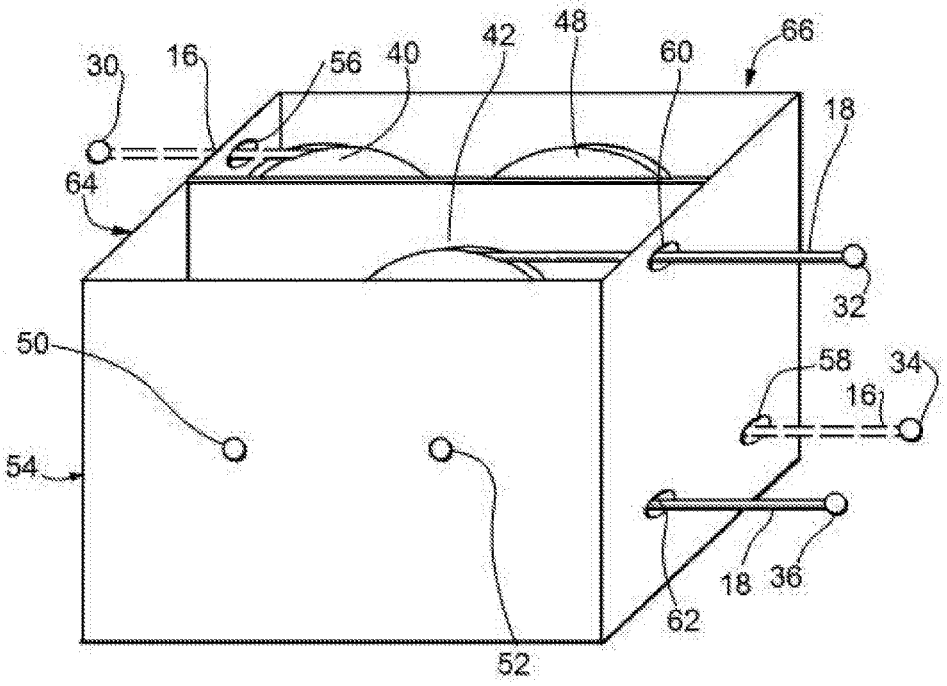
FIG. 3 shows a perspective view of pulley assembly for a left gate.
Figure 4:
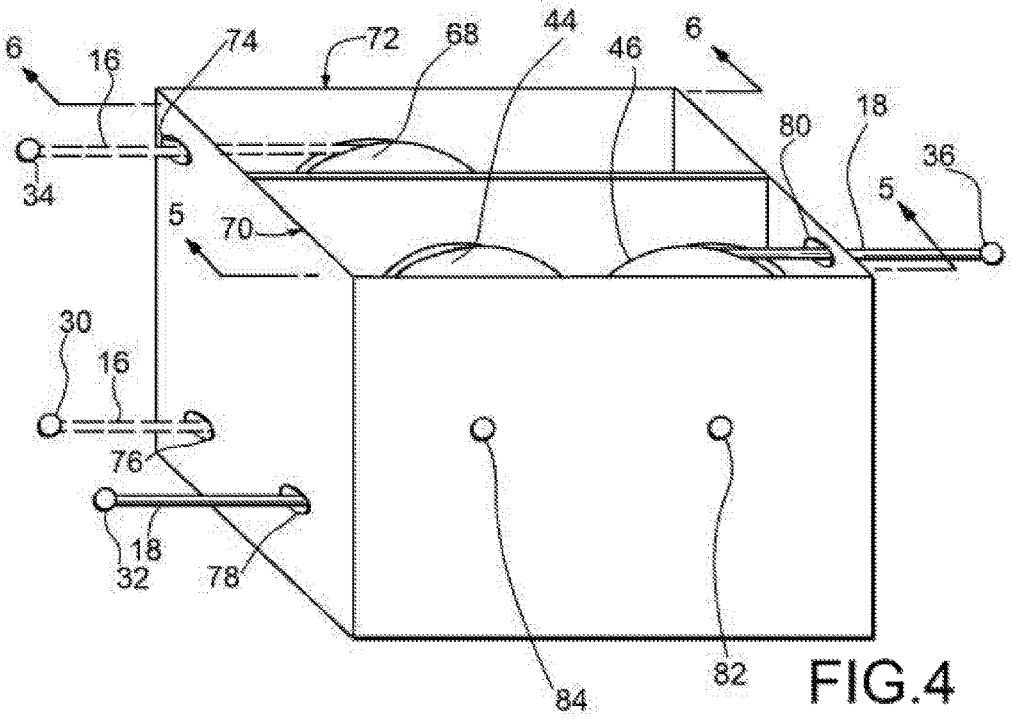
FIG. 4 is shows a perspective view of a pulley assembly rotated for a right gate.

In FIGS. 1 and 2 the pulley assembly 12 and pulley assembly 14 are shown without the protective and structural case demonstrated in more detail in subsequent drawings. Pulleys 40 and 42 at the left gate 20 and pulleys 44 and 46 at the right gate 22 are shown to better illustrate the pathways of cable 16 and cable 18. A more detailed depiction of pulley assembly 12 is shown in FIG. 3 and more details of pulley assembly 14 are shown in FIG. 4.

Gate 20 and gate 22 may ride on ground contacting wheels 38. The wheels 38 may ride on a track or other segment of fence, neither shown in the drawings. There are other gate movement mechanisms that would work equally well with the present invention when applied to a pair of opposed sliding gates.

The pulley assemblies 12 and 14 should be securely connected to the earth slightly farther away from the centerline 28 than the farthest the gates 20 and 22 can open. This is because the cables 16 and 18 can only pull and not push the gates 20 and 22. In many installations the pulley assemblies 12 and 14 are at or just outboard of the respective posts 24 and 26 and are thereby protected by the posts 24 and 26 from accidental contact and resulting damage.

In FIGS. 1 and 2 pulley 48 is not visible behind pulley 42 and pulley 68 is hidden behind pulley 44. Pulleys 48 and 68 are present in FIGS. 1 and 2 but are more clearly shown in FIGS. 3 and 4.

Cable 16 is connected on one end to the gate 20 on the outboard side at anchor 30 and at the opposite end on the other gate 22 on the medial side at anchor 34. When a closing force is applied to gate 22 the integral anchor 34 is moved towards the centerline 28 thus cable 16 is under tension and pulls at anchor 30 on the opposing gate 20 thereby pulling gate 20 closed as well. Simultaneously, as gate 20 is being pulled closed, cable 18 is put under tension and pulls at anchor 36 that further tends to close gate 22 towards the centerline 28.

Conversely, when an opening force is applied to gate 20, cable 16 is moved with the gate affixed at anchor 30 putting the cable 16 under tension and pulling gate 22 open from anchor 34. Similarly, as gate 22 is opened, cable 18 is pulled from anchor 36 that in turn pulls the opposite end of cable 18 at anchor 32 pulling gate 20 open. In this way, any opening force on one gate transfers opening force to the other gate and any closing force on one gate is equally transferred by the cables to close the other gate simultaneously.

FIG. 3 shows in more detail the pulley assembly 12 as configured in FIGS. 1 and 2. FIG. 4 shows in more detail the pulley assembly 14 as configured in FIGS. 1 and 2. It should be appreciated that the structure of pulley assembly 12 and pulley assembly 14 are identical in structure and differ primarily in how cables 16 and 18 are routed through the pulleys contained therein.

The pulley assembly 12 is generally contained in the case assembly 54. The case assembly 54 is compartmentalized into sub-box 64 and sub-box 66. Sub-box 64 contains pulley 42 and returns cable 18. Sub-box 66 contains pulleys 40 and 48 and guides cable 16.

Cable 16 is affixed at one end to anchor 34 and enters sub-box 66 through aperture 58 below the pulley 48. The cable 16 is routed over pulley 40 and exits the sub-box 66 through aperture 56 where the cable 16 terminates at anchor 30.

Cable 18 is affixed at one end to anchor 32 on gate 20. The other end of cable 18 terminates at anchor 36. Cable 18 enters sub-box 64 through aperture 62, wraps around pulley 42 and exits sub-box 64 through aperture 60. Pulley 40 is supported by axle 50. Pulleys 42 and 48 are supported by axle 52.

FIG. 4 shows pulley assembly 14 as configured in FIGS. 1 and 2. Cable 16 enters sub-box 72 at aperture 76, passes around pulley 68, and return out of sub-box 72 via aperture 74. Cable 18 enters sub-box 70 at aperture 78 where is passes under pulley 44 and then over pulley 46 where the cable 18 then exits the opposite side of sub-box 70 through aperture 80 and terminates at anchor 36. Pulleys 68 and 44 are supported by axle 84. Pulley 46 is supported by axle 82.

Between gates 20 and 22 is the pathway that the gates allow human and vehicular passage through. Both cables 16 and 18 travel under or along the bottom of this passage. Cables 16 and 18 must be low to the ground between the gates 20 and 22 to allow traffic to easily pass thought the gates without impedance.

As the cable 16 (and similarly cable 18) passes outside of the pathway between the gates and into the pulley assembly 12, the cable is raised off of the ground when it travels over pulley 40 as cable 16 continues on its way to anchor 30 at the outboard side of gate 20. Be keeping the cable 16 off of the ground when it is away from the pathway it preserves the life of the cable 16. The cable 16 will not drag on the ground or interfere with the wheels 38 thereby extending the life of the cable 16.

Following cable 16 (and similarly cable 18) out of pulley assembly 12, the cable 12 is held low under pulley 48 so that it will not be raised above the ground surface between gates 20 and 22 where it could interfere with passing traffic.

Figure 5:
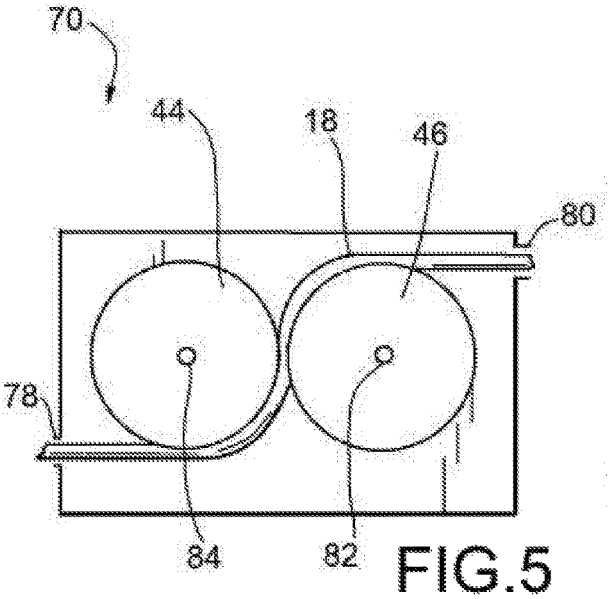
FIG. 5 is an elevation cross-section view of a pulley assembly.
Figure 6:
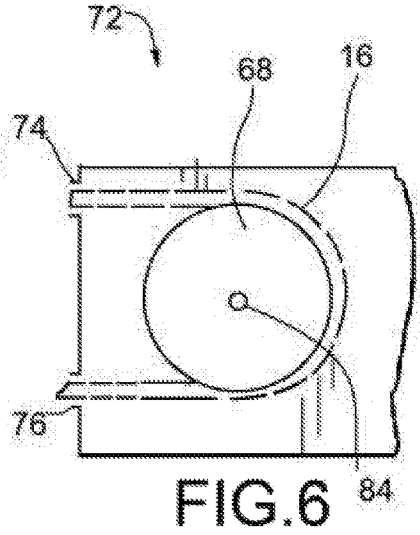
FIG. 6 is an elevation cross-section view of a pulley assembly.

FIGS. 5 and 6 demonstrate the cables 16 and 18 paths through pulley assembly 14 along section lines identified in FIG. 4. Cable 18 can be seen entering sub-box 70 through the lower aperture 78 then passing under pulley 44. Cable 18 is then raised off of the ground by going over pulley 46 before it exits the sub-box 70 through aperture 80 and terminates at anchor 36 on the gate 22.

Cable 16 is affixed to gat 22 at anchor 34 and enters sub-box 72 at aperture 74, wraps around pulley 68 and returns out of sub-box 72 by aperture 76 and terminates on gate 20 at anchor 30. Notice that there is only one pulley 68 needed in sub-box 72. Sub-box 70 and sub-box 72 are generally unified into case 54.

Figure 7:
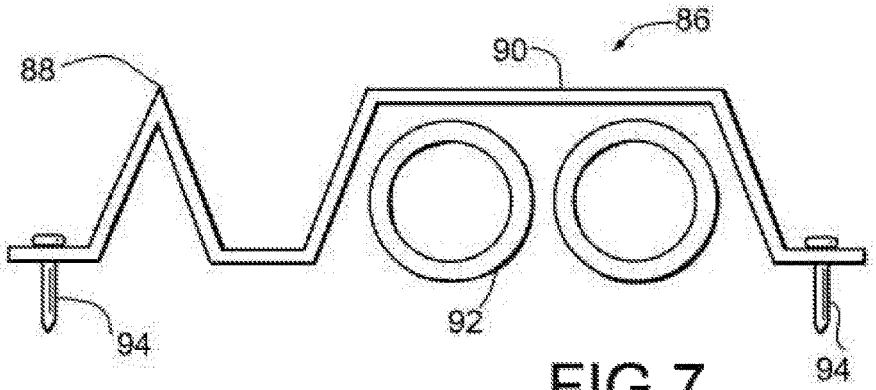
FIG. 7 is an elevation cross-section view of a channel assembly.
Figure 8:
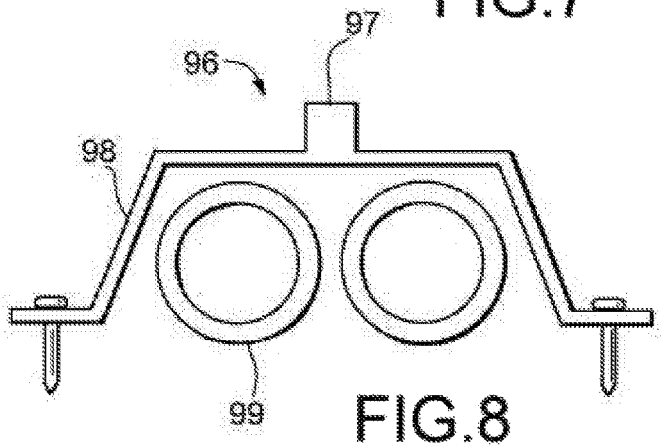
FIG. 8 is an elevation cross-section view of a channel assembly.

FIG. 7 shows a version of a channel assembly 86. FIG. 8 shows another version of a channel assembly 96. Generally, channel assemblies 86 or 96 may be secured to the earth between pulley assemblies 12 and 14 to provide, among other things, a safe path for cables 16 and 18 and allow these cables 16 and 18 to slide freely during opening and closing operations of the gates 20 and 22.

The channel assemblies 86 and 96 must be durable enough to survive anticipated traffic passing between the gates 20 and 22. Galvanized or coated steel or other alloys or polymers could each be effective if designed with sufficient structural strength and rigidity to support both the gates 20 and 22 and traffic.

In some applications no conduit for the cables 16 and 18 would be needed. In other applications a basic surface or buried conduit to protect the cables 16 and 18 can be used.

It is not necessary for all versions of a channel assembly to support the weight of the gate or provide a track or rail on which the gates can ride. Each cable could have its own conduit or a single conduit could contain the two cables needed for controlling the gate opener.

FIG. 7 shows one example of a channel assembly 86 and is provided to demonstrate exemplary features that may be used alone or in combination with other channel assembly designs, such as the channel assembly 96 seen in FIG. 8.

Fasteners 94 are provided to secure the channel assembly 86 to the earth between the pulley assemblies 12 and 14. Conduits 92, present singly or in pairs, are protected from impact under the covering 90. The rail 88 acts as a track that the wheels 38 of the gates 20 and 22 can smoothly ride upon. The rail 88 may optionally be a part of the channel assembly 86 or could be a separate structure.

FIG. 8 demonstrates a more compact channel assembly 96 where the rail 97 upon which the wheels 38 ride are integral to the covering 98. The covering 98 protects the conduits container therein. Any design of a channel assembly may be positioned on the ground surface or partially submerged to reduce the impact that the channel assembly may have on traffic rolling over it.

An important version of the invention can fairly be described as a gate opener assembly for opposed sliding gates 20 and 22 comprised of a first pulley assembly 12, a second pulley assembly 14, a first cable 16 and a second cable 18. The opposed sliding gates 20 and 22 travel along a gate path, often on wheels 38, between an open mode where passage between the gates can occur and a closed mode where the opposed sliding gates meet at a centerline 28 and the gate is closed. The first pulley 12 assembly is substantially identical to the second pulley assembly 14. Each pulley assembly 12 and 14 has a return pulley 42 and 68 defining a first cable path. Each pulley assembly 12 and 14 has a hold down pulley 48 and 44 and a lifter pulley 40 and 68 that together define a second cable path. The first cable path is parallel to both the second cable path and the gate path, all run along the travel path of the gates 20 and 22. The opposed sliding gates are comprised of a first gate 20 and a second gate 22, each having a medial edge nearer the centerline and a lateral (or outboard) edge away from the centerline. The first pulley assembly 12 is affixed stationary to the ground between the medial edge and lateral edge of the first gate 20 in the open mode. The first and second pulley assemblies are generally best positioned just outboard of the medial edge of each gate when the gates are in the open mode so that the possible range of gate travel is maximized. The second pulley assembly 14 is affixed stationary to the ground between the medial edge and lateral edge of the second gate in the open mode. The first pulley assembly 12 is oriented substantially one hundred eighty degrees relative to the second pulley assembly 14. The hold down pulley 48 and 44 in both the first and second pulley assemblies 12 and 14 are positioned nearer the centerline 28 than the lifter pulley 40 and 46. The first cable 16 is anchored 34 on a first end to the medial edge of the second gate 22 and passes over then under the return pulley 68 in the second pulley assembly 14 then under the hold down pulley 48 in the first pulley assembly 12 then over the lifter pulley 40 in the first pulley assembly 12 then at a second end is anchored 30 to the lateral edge of the first gate. The second cable 18 is anchored 32 on a first end to the medial edge of the first gate 20 and passes over then under the return pulley 42 in the first pulley assembly 12 then under the hold down pulley 44 in the second pulley assembly 14 then over the lifter pulley 46 in the second pulley assembly 14 then at a second end is anchored 36 to the lateral edge of the second gate 22.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A gate opener assembly for opposed sliding gates, the gate opener assembly comprising a first pulley assembly, a second pulley assembly, a first cable and a second cable, wherein:

the opposed sliding gates travel along a gate path between an open mode and a closed mode where the opposed sliding gates meet at a centerline;

the first pulley assembly is substantially identical to the second pulley assembly;

each pulley assembly has a return pulley defining a first cable path;

each pulley assembly has a hold down pulley and a lifter pulley that together define a second cable path;

the first cable path is parallel to both the second cable path and the gate path;

each of the hold down pulleys, lifter pulleys and return pulleys are freely rotating and are operatively connected only by the respective first cable and second cable;

the opposed sliding gates are comprised of a first gate and a second gate, each having a medial edge and a lateral edge;

the first pulley assembly is affixed stationary to a ground surface between the medial edge and lateral edge of the first gate in the open mode;

the second pulley assembly is affixed stationary between the medial edge and lateral edge of the second gate in the open mode;

the first pulley assembly is oriented substantially one hundred eighty degrees relative to the second pulley assembly so that the hold down pulley in both the first and second pulley assemblies are positioned nearer the centerline than the lifter pulley;

the first pulley assembly has a pulley assembly width measured in a direction parallel to the first cable path;

a travel path width is a distance between the medial edge of the first gate and medial edge of the second gate when in the open mode;

the width of each of the first gate and second gate is greater than or equal to the pulley assembly width plus half the travel path width;

the first cable is anchored on a first end to the medial edge of the second gate and passes over then under the return pulley in the second pulley assembly then under the hold down pulley in the first pulley assembly then over the lifter pulley in the first pulley assembly to raise the first cable off the ground surface and terminating at a second end anchored to the lateral edge of the first gate;

the second cable is anchored on a first end to the medial edge of the first gate and passes over then under the return pulley in the first pulley assembly then under the hold down pulley in the second pulley assembly then over the lifter pulley in the second pulley assembly to raise the second cable off the ground surface and terminating at a second end anchored to the lateral edge of the second gate; and the first cable path and second cable path between the first pulley assembly and second pulley assembly are below a bottom edge of the first gate and the second gate.

2. The gate opener assembly for opposed sliding gates as in claim 1 further characterized in that a protective conduit contains the first cable and the second cable between the first pulley assembly and the second pulley assembly.

* * * * *